US006274973B1

(12) United States Patent
Mochiduki et al.

(10) Patent No.: US 6,274,973 B1
(45) Date of Patent: Aug. 14, 2001

(54) ELECTRIC DISCHARGE LAMP APPARATUS WITH INSULATING PLUG

(75) Inventors: Kunimasa Mochiduki; Masato Harazaki; Yasuyoshi Numajiri; Takeshi Fukuyo; Yoshitaka Ohshima; Shinichi Irisawa, all of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/201,845

(22) Filed: Dec. 1, 1998

(30) Foreign Application Priority Data

Dec. 8, 1997 (JP) ..... 9-337090

(51) Int. Cl.[7] ..... H01J 5/56

(52) U.S. Cl. ..... 313/318.09; 313/318.1; 439/613

(58) Field of Search ..... 313/25, 318.01, 313/318.09, 318.1; 439/613, 602

(56) References Cited

U.S. PATENT DOCUMENTS

| | | | | |
|---|---|---|---|---|
| 5,059,855 | | 10/1991 | Irisawa et al. | 313/318 |
| 5,177,397 | | 1/1993 | Nagasawa et al. | 313/318 |
| 5,250,872 | | 10/1993 | Wakimizu et al. | 313/25 |
| 5,412,275 | * | 5/1995 | Dorsemagen et al. | 313/318.01 |
| 5,432,399 | | 7/1995 | Nagasawa et al. | 313/25 |
| 5,627,428 | | 5/1997 | Helbig et al. | 313/318.01 |
| 5,736,811 | | 4/1998 | Westemeyer et al. | 313/318.02 |
| 5,742,114 | | 4/1998 | Kohl et al. | 313/318.01 |
| 5,757,110 | | 5/1998 | Motiduki et al. | 313/25 |
| 6,031,323 | * | 2/2000 | Behr et al. | 313/318.01 |

FOREIGN PATENT DOCUMENTS

| | | | |
|---|---|---|---|
| A2 0 376 260 | 7/1990 | (EP) | H01J/5/54 |
| A1 0 570 068 | 11/1993 | (EP) | H01J/61/34 |
| A1 0 579 326 | 1/1994 | (EP) | H01J/5/56 |
| A 2 275 567 | 8/1994 | (GB) | H01J/9/30 |
| 8-162007 | 6/1996 | (JP) | H01J/5/50 |

OTHER PUBLICATIONS

Patent Abstracts of Japan vol. 015, No. 326 (E–1102), Aug. 20, 1991 & JP 03 122941 A (Koito Mfg Co.Ltd.) May 24, 1991, *Abstract.

* cited by examiner

*Primary Examiner*—Michael H. Day
(74) *Attorney, Agent, or Firm*—Sughrue, Mion, Zinn, Macpeak & Seas, PLLC

(57) ABSTRACT

An electric discharge lamp apparatus incorporates: a metal lead support 36 which projects over the front surface of an insulating plug 30 made of synthetic resin, which supports the leading end of an arc tube 10 and which serves as a passage for electric power arranged to be supplied to the arc tube 10; and an insulating sleeve 38 which is made of ceramics formed into a pipe shape and through which the lead support 36 is inserted, wherein a predetermined gap S2 is provided between the insulating sleeve 38 and the lead support 36. Thus, insertion of the lead support 36 into the insulating sleeve 38 can easily be performed, and a dimension error of the insulating sleeve 38 can be absorbed. Since a bent portions 36*a* is provided for a portion of the lead support 36 into which the insulating sleeve is inserted, the insulating sleeve 38 and the lead support 36 can hermetically integrated with each other. Thus, rattle of the insulating sleeve 38 with respect to the lead support 36 can be prevented.

6 Claims, 10 Drawing Sheets

ELECTRIC DISCHARGE LAMP APPARATUS WITH INSULATING PLUG

BACKGROUND OF THE INVENTION

The present invention relates to an electric discharge lamp apparatus having a structure that a metal lead support arranged to support the leading end of an arc tube and serving as a passage for supplying electric power to an arc tube projects over an insulating plug thereof.

As shown in FIG. 17, a conventional electric discharge lamp apparatus has a structure that an arc tube 5 is integrally secured at a position in front of an insulating plug, i.e. an insulating base 1 made of synthetic resin.

The arc tube 5 has a structure that an ultraviolet-ray shielding globe 9 is integrally welded to an arc tube body 6 having an enclosed glass bulb 7 which is a light emitting portion in which electrodes 7*a* and 7*b* are disposed opposite to each other. Thus, the enclosed glass bulb 7 is surrounded and sealed by the ultraviolet-ray shielding globe 9. The electrodes 7*a* and 7*b* are connected to lead wires 8*c* and 8*d* extending from the arc tube 5 through molybdenum foil portions 8*a* and 8*b* bonded to pinch seal portions 8.

The rear end of the arc tube 5 is inserted into an engaging hole la formed in the insulating plug 1. The rear outer surface of the disc 2 is held by a dish-shape disc 2 made of ceramics and secured to the front surface of the insulating plug 1 with screws. Moreover, the leading end of the arc tube 5 is supported by a metal lead support 3 forwards projecting over the insulating plug 1 and serving as a passage for supplying electric power to the arc tube 5. Thus, the arc tube 5 is integrally secured to the insulating plug 1. Reference numeral 2*a* represents bond with which the inside portion of the disc 2 is filled. A ceramic insulating sleeve 4 is arranged to maintain insulation between the positive-side electric-power passages 8*d*, 8*b* and 7*b* and the metal lead support 3 which is a negative-side electric-power passage, the insulating sleeve 4 being formed into a cylindrical pipe shape disposed to cover the metal lead support 3.

The above-mentioned conventional electric discharge lamp apparatus has the structure that the insulating sleeve 4 covers the metal lead support 3. When the electric discharge lamp apparatus is assembled, the metal lead support 3 must be inserted into the ceramic sleeve 4. To smoothly insert the lead support 3 into the sleeve 4, the inner diameter of the sleeve 4 must be larger than the outer diameter of the lead support 3. However, if the inner diameter of the sleeve 4 is enlarged a gap is formed from the inserted lead support 3. As a result, the two elements 3 and 4 are relatively moved, causing noise to be made. Moreover, there is apprehension that the sleeve 4 is broken. Therefore, the conventional structure has been arranged to smoothly perform the process for inserting the lead support and prevent noise and breakage of the sleeve by making the inner diameter of the sleeve 4 to be slightly larger than the outer diameter of the lead support 3.

The insulating sleeve 4 is molded by sintering. Since the volume is reduced after the insulating sleeve 4 has been sintered, it is difficult to accurately control the dimension accuracy of the sleeve 4 (the inner and outer diameters and the straightness). Therefore, the manufacturing yield of the molded sleeve 4 is unsatisfactory and thus the cost of the electric discharge lamp apparatus is enlarged excessively.

To solve the above-mentioned problems experienced with the conventional technique, an object of the present invention is to provide an electric discharge lamp apparatus with which satisfactory workability is realized when the electric discharge lamp apparatus is assembled, which is free from apprehension of noise and breakage of the sleeve and which enables cost to be reduced.

To achieve the above-mentioned object, according to a first aspect of the invention, there is provided an electric discharge lamp apparatus comprising: an arc tube; an insulating plug made of synthetic resin, the insulating plug supporting the arc tube; a metal lead support serving as a passage for electric power to be supplied to the arc tube, wherein the metal lead support has a bent portion; an insulating sleeve made of ceramics wherein the insulating sleeve has a hollow pipe shape and an inner surface into which the lead support is inserted, wherein a predetermined gap is provided between the inner surface of the insulating sleeve and an outer surface of the lead support, and the bent portion of the metal lead support comes contact with the inner surface of the insulating sleeve.

The gap between the inner surface of the insulating sleeve and the outer surface of the lead support has a size with which the bent portion of the lead support is brought into close contact with the inner surface of the insulating sleeve so that the lead support and the insulating sleeve are integrated with each other. Moreover, when the lead support is inserted into the insulating sleeve, the size enables the bent portion of the lead support to elastically be deformed to smoothly insert the lead support into the insulating sleeve.

Since the inner diameter of the insulating sleeve is larger than the outer diameter of the lead support and the bent portion can elastically be deformed along the insulating sleeve when the lead support is inserted into the sleeve, the lead support can smoothly be inserted into the insulating sleeve even if the inner diameter of the insulating sleeve has an error or the insulating sleeve is warped.

Since the lead support is pressed against the insulating sleeve at a plurality of positions in the lengthwise direction in the insulating sleeve, the insulating sleeve is integrated with the lead support. Therefore, the two elements are not relatively vibrated by dint of transmitted vibrations and thus looseness of the two elements can be prevented. As a result, the apprehension that the insulating sleeve is broken can be eliminated.

According to a second aspect of the invention, there is provided the electric discharge lamp apparatus of the first aspect, wherein the insulating plug has a sleeve insertion hole which is opened in the front surface of the insulating plug and through which the rear end of the insulating sleeve is inserted so as to be accommodated, and the predetermined gap is provided between the inner surface of the sleeve insertion hole and the outer surface of the insulating sleeve.

The insulating sleeve is disposed to also cover a region of the lead support extending into the insulating plug in addition to the portion forwards extending over the insulating plug. As a result, insulation between the positive-side electric-power passage and the negative-side electric-power passage disposed opposite to each other can be maintained.

The diameter of the sleeve insertion hole is larger than the outer diameter of the insulating sleeve. Therefore, even if the outer diameter of the insulating sleeve has an error or if the insulating sleeve is warped the insulating sleeve can smoothly be inserted into the sleeve insertion hole.

According to a third aspect of the invention, there is provided the electric discharge lamp apparatus of the second aspect, wherein the insluating plug has a lead-support insertion hole, and a tapered hole communicating between the sleeve insertion hole and the lead-support insertion hole.

The rear end of the lead support which has been pushed into the insulating sleeve and which has penetrated the insulating sleeve is moved along the tapered hole so as to be guided into the lead-support insertion hole.

According to a fourth aspect of the invention, there is provided the electric discharge lamp apparatus of the third aspect, wherein the lead-support insertion hole is eccentric with respect to the sleeve insertion hole, and the lead support which is inserted through the lead-support insertion hole and which is eccentric with respect to the sleeve insertion hole presses a side surface of the insulating sleeve against the inner surface of the sleeve insertion hole.

Since the lead support which is eccentric from the central axis of the sleeve insertion hole presses the overall region of a side surface of the inner surface of the insulating sleeve in the lengthwise direction, looseness of the insulating sleeve with respect to the sleeve insertion hole can be prevented.

DETAILED DESCRIPTION OF THE PREFERRED EMBODIMENTS

Embodiments of the present invention will now be described.

Figure 1:
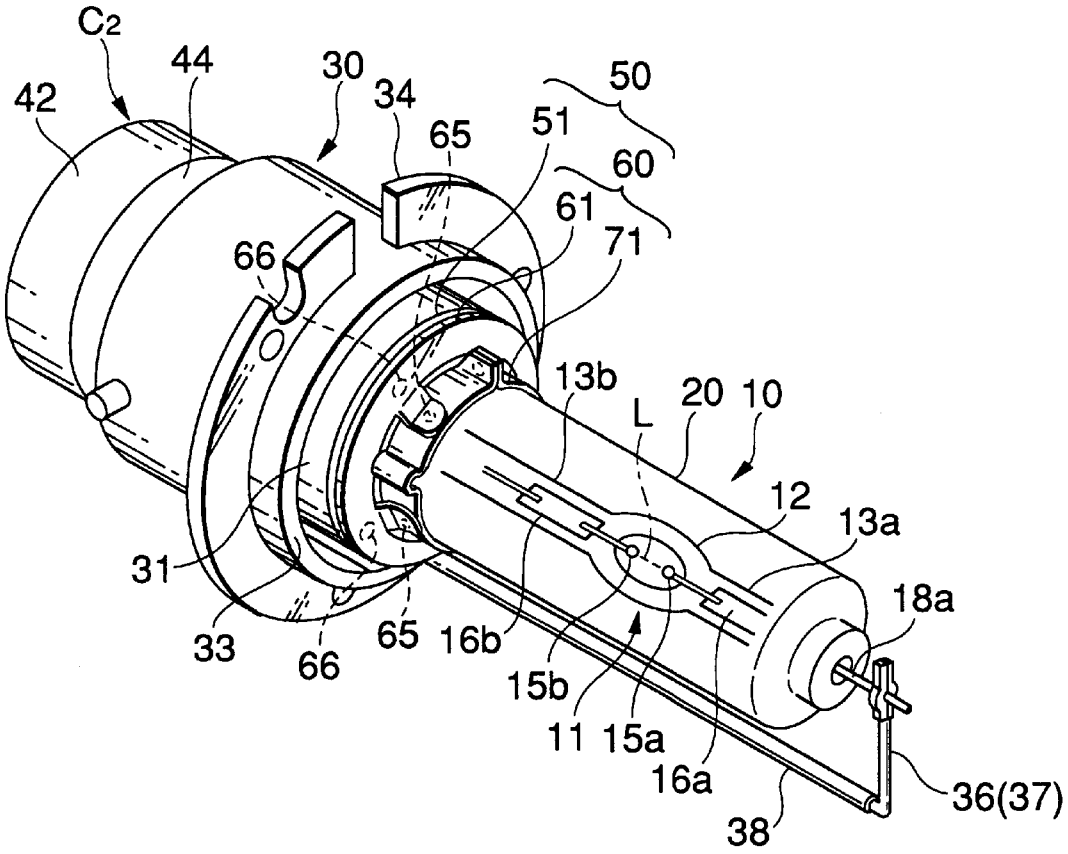
FIG. 1 is a perspective view showing an electric discharge lamp apparatus according to a first embodiment of the present invention.
Figure 2:
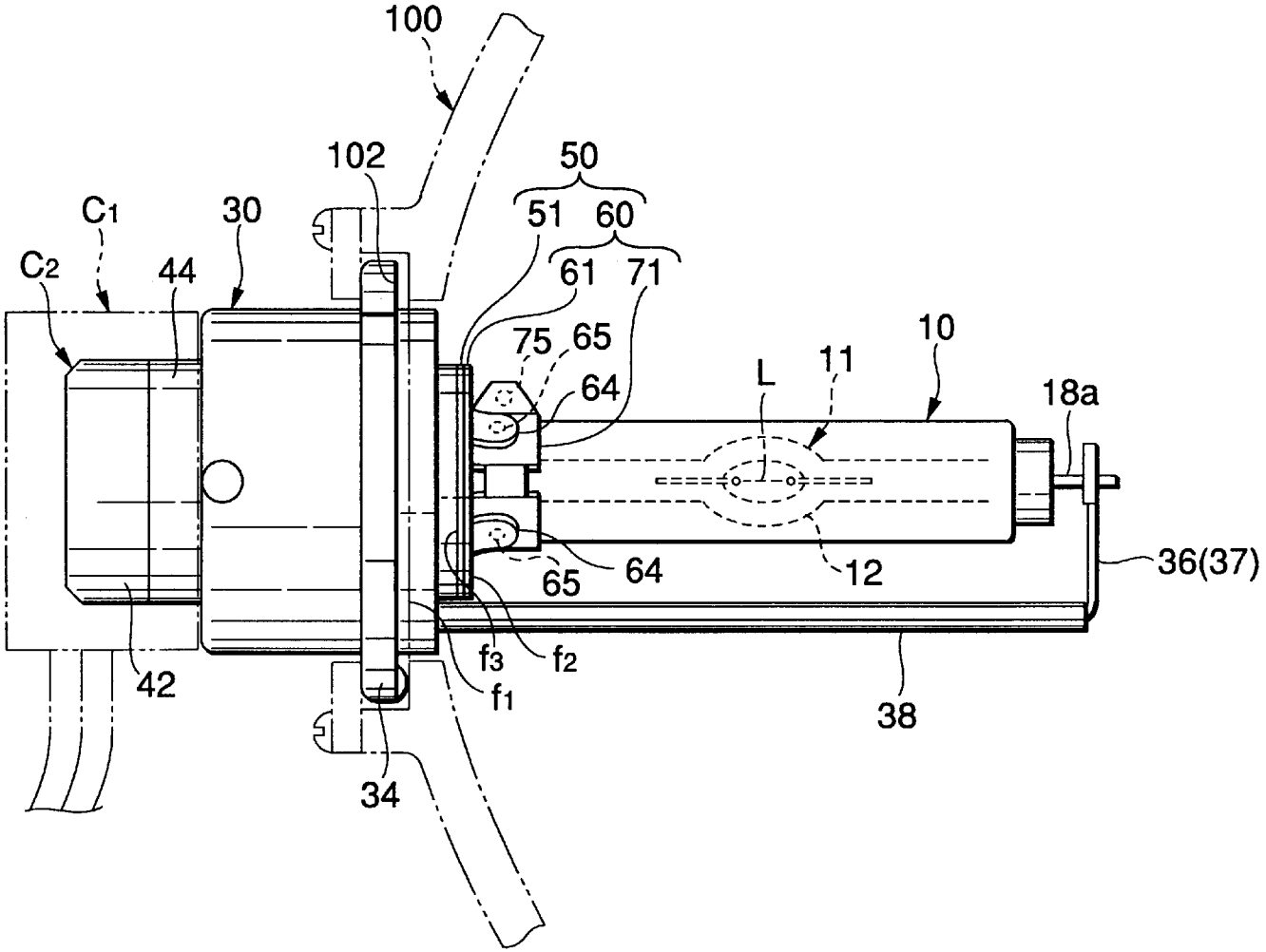
FIG. 2 is a side view showing the electric discharge lamp apparatus.
Figure 3:
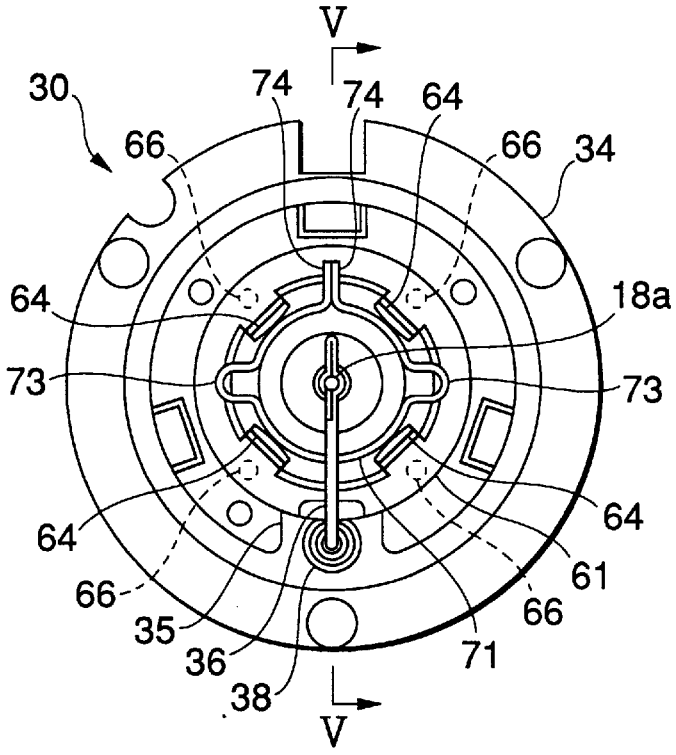
FIG. 3 is a front view showing the electric discharge lamp apparatus.
Figure 4:
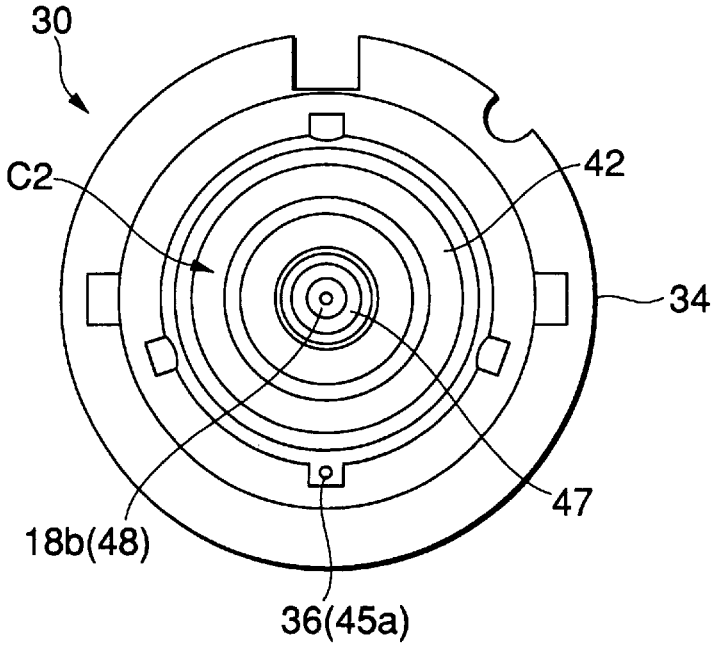
FIG. 4 is a rear view showing the electric discharge lamp apparatus.
Figure 5:
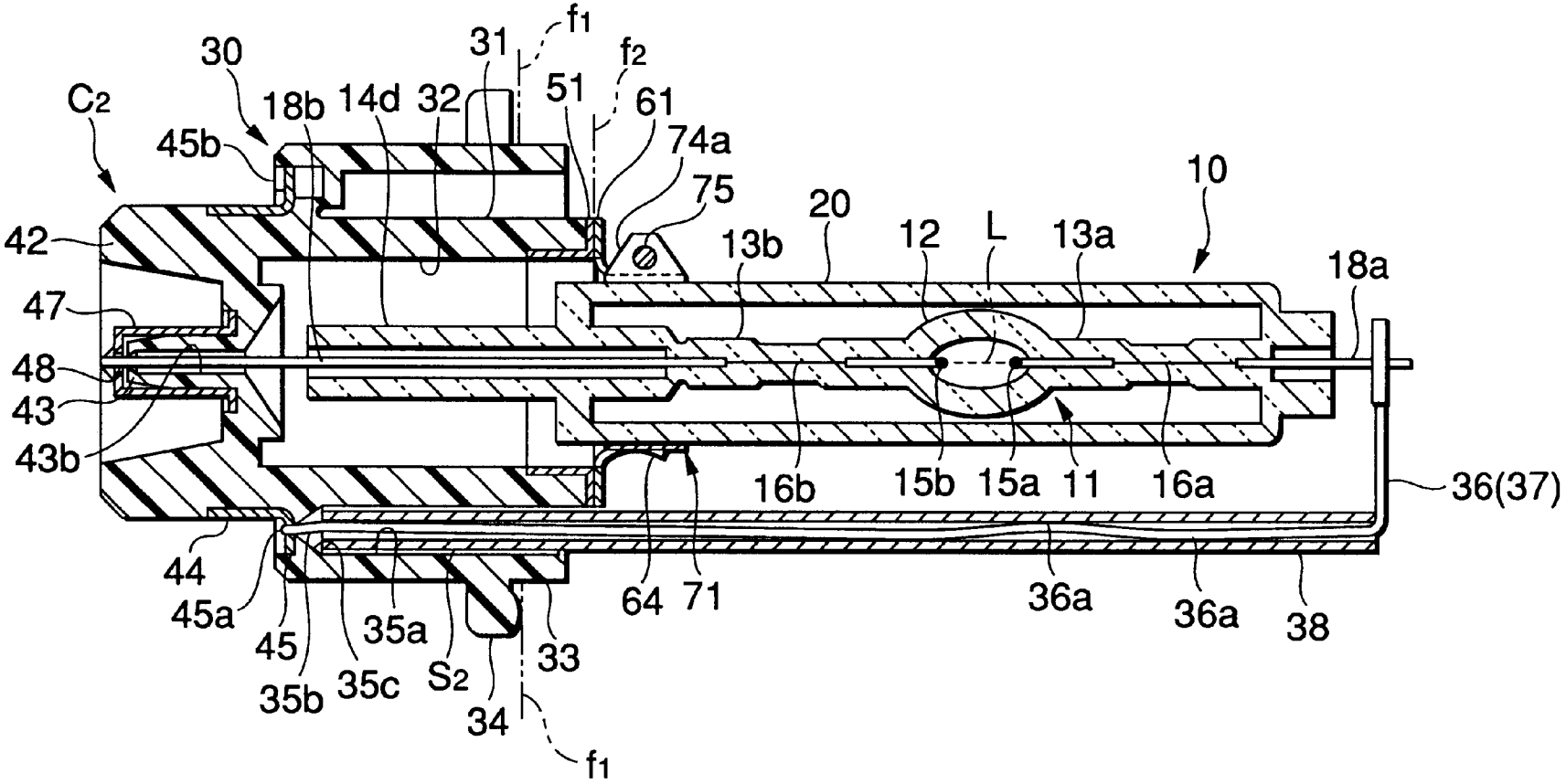
FIG. 5 is a vertical cross sectional view (a cross sectional view taken along line V—V shown in FIG. 3) showing the electric discharge lamp apparatus.
Figure 6:
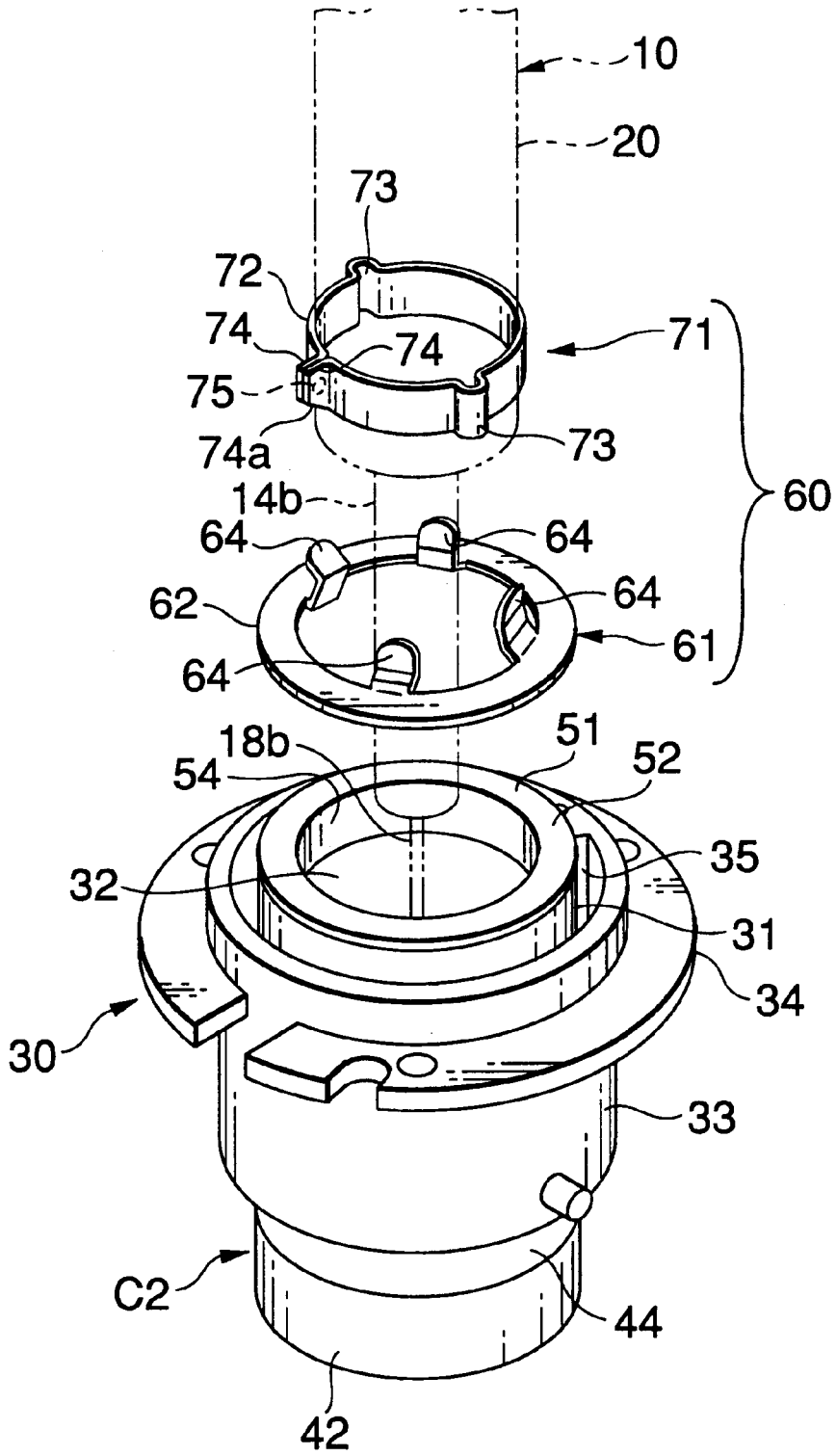
FIG. 6 is an exploded perspective view showing a vertically-holding member for holding the arc tube.
Figure 7:
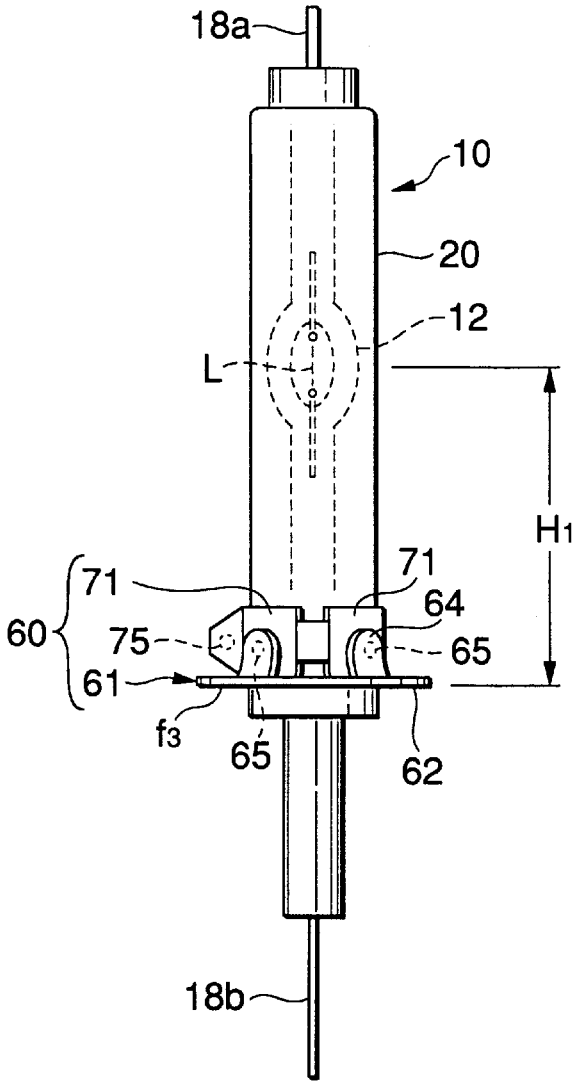
FIG. 7 is a side view showing the arc tube to which the vertically-holding member has been secured and integrated.
Figure 8:
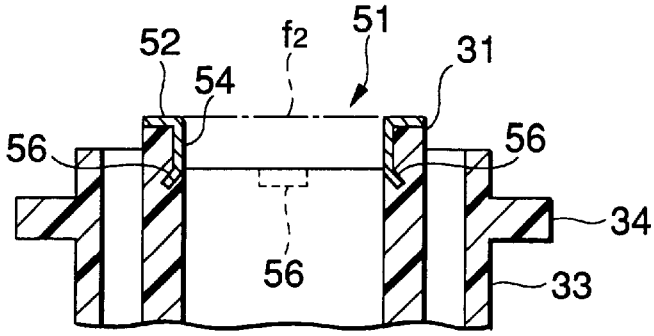
FIG. 8 is a vertical cross sectional view showing a front portion of the insulating plug to which a base plate has been secured and integrated.
Figure 9:
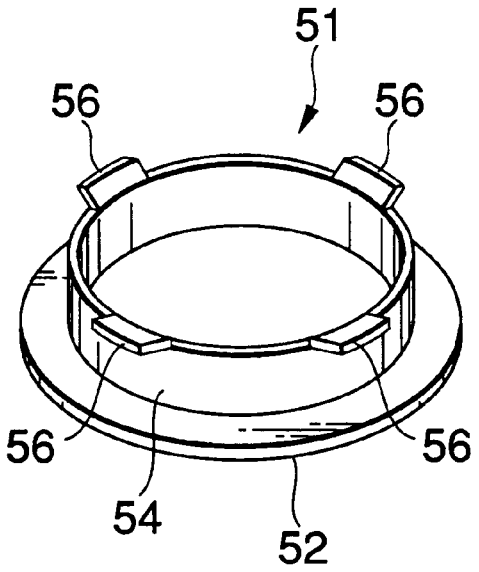
FIG. 9 is a rear perspective view showing the base plate.
Figure 10:
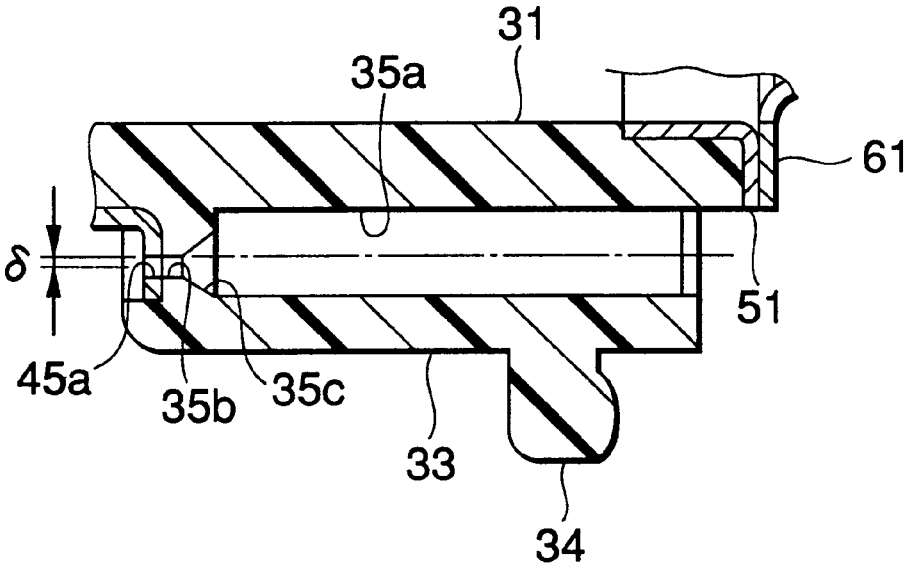
FIG. 10 is an enlarged cross sectional view showing a sleeve insertion hole.
Figure 11:
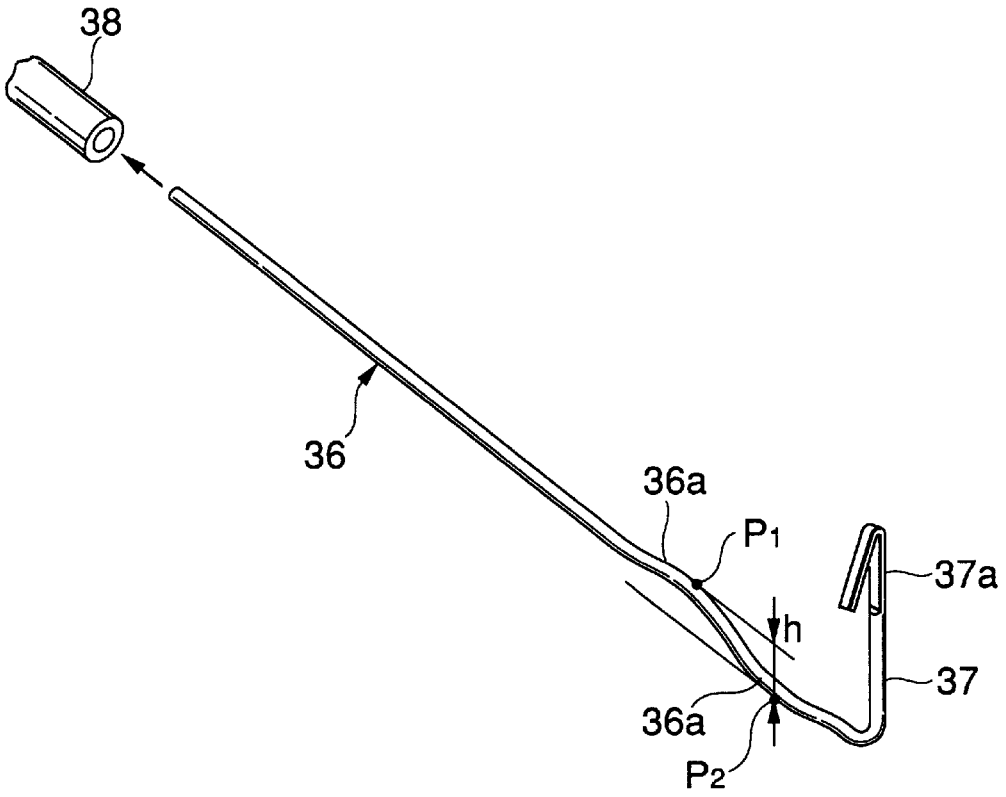
FIG. 11 is a perspective view showing a state in which a lead support is inserted into an insulating sleeve.
Figure 12:
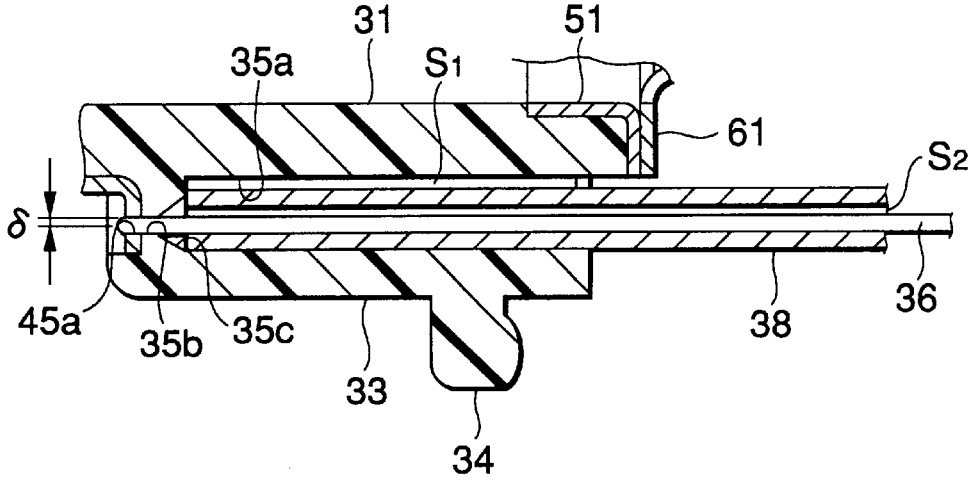
FIG. 12 is an enlarged cross sectional view showing a portion in the vicinity of the sleeve insertion hole into which the insulating sleeve has been inserted.
Figure 13:
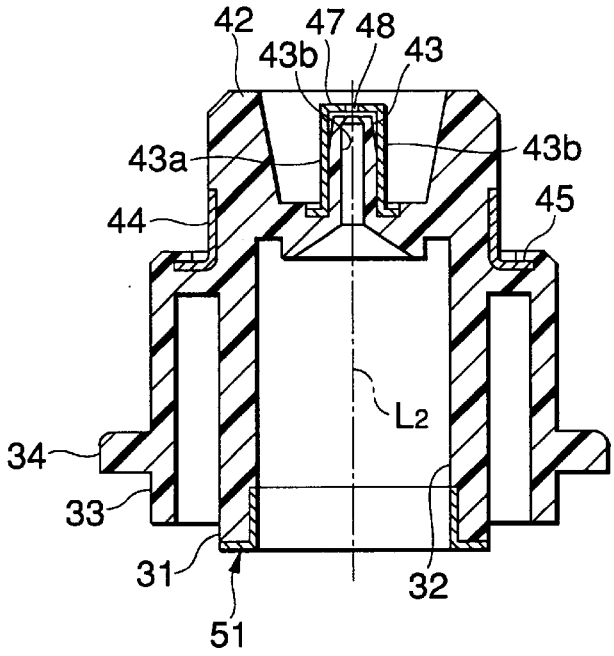
FIG. 13 is a vertical cross sectional view showing the insulating plug having a rear end which faces upwards.
Figure 14:
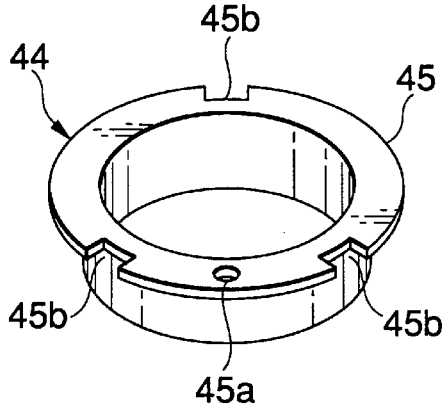
FIG. 14 is a rear perspective view showing a belt-type terminal.
Figure 15:
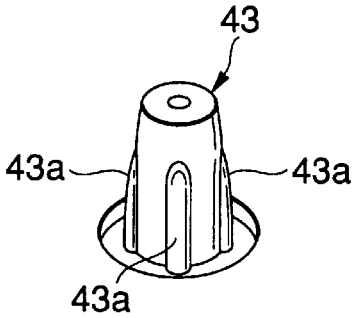
FIG. 15 is a perspective view showing a boss to which a cap-type terminal is fitted.

FIGS. 1 to 15 show a first embodiment of the present invention. FIG. 1 is a perspective view showing an electric discharge lamp apparatus according to a first embodiment of the present invention. FIG. 2 is a side view showing the electric discharge lamp apparatus. FIG. 3 is a front view showing the electric discharge lamp apparatus. FIG. 4 is a rear view showing the electric discharge lamp apparatus. FIG. 5 is a vertical cross sectional view (a cross sectional view taken along line V—V shown in FIG. 3) showing the electric discharge lamp apparatus. FIG. 6 is an exploded perspective view showing a vertically-holding member for holding an arc tube. FIG. 7 is a side view showing the arc tube to which the vertically-holding member has integrally been secured. FIG. 8 is a vertical cross sectional view showing a front end of the insulating plug to which a base plate has integrally been secured. FIG. 9 is a rear perspective view showing the base plate. FIG. 10 is an enlarged cross sectional view showing a portion in the vicinity of the sleeve insertion hole into which the insulating sleeve has been inserted. FIG. 11 is a perspective view showing a state in which a lead support is inserted into the insulating sleeve. FIG. 12 is an enlarged cross sectional view showing the portion in the vicinity of the sleeve insertion hole into which the insulating sleeve has been inserted. FIG. 13 is a vertical cross sectional view showing an insulating plug having a rear end facing upwards. FIG. 14 is a rear perspective view showing a belt-type terminal. FIG. 15 is a perspective view showing a boss to which a cap-type terminal is fitted.

Referring to the drawings, an insulating plug 30 is made of synthetic resin and incorporating a lamp-side connector C2 which can be connected to a connector C1 (see FIG. 2) for supplying electric power and which is integrally formed at the rear end thereof. The insulating plug 30 has a focusing ring 34 disposed on the outer surface thereof, the focusing ring 34 constituting a contact reference plane f1 (see FIGS. 2 and 5) which is engaged to a bulb insertion hole 102 (see FIG. 2) of a reflector 100 of a headlamp for a vehicle. In front of the insulating plug 30, an arc tube 10 is secured and supported by a lead support 36 made of a metal material and extending forwards over the plug 30 and a metal support member 50 secured to the front surface of the plug 30. Thus, the electric discharge lamp apparatus is constituted.

That is, a lead wire 18*a* extending from the front end of the arc tube 10 is, by spot welding, secured to a folded leading end 37 of a lead support 36 extending from the insulating plug 30. Moreover, a trailing end of the arc tube 10 is held by a metal support member 50 comprising a metal base plate 51 secured to the front surface of the insulating plug 30, a slide plate 61 and an arc-tube holding band 71.

The arc tube 10 has a structure that a cylindrical ultraviolet-ray shielding globe 20 is welded and hermetically joined to an arc tube body 11 having an enclosed glass bulb 12 in which electrodes 15*a* and 15*b* are disposed opposite to each other. Thus, the enclosed glass bulb 12 is surrounded by the ultraviolet-ray shielding globe 20. Symbol L represents an electrically-discharging axis which connects the electrodes 15*a* and 15*b* to each other.

The arc tube body 11 includes the enclosed glass bulb 12 which has been manufactured from a quartz glass pipe in the form of a cylindrical pipe, which is formed at a predetermined position in the lengthwise direction and which has a rotative elliptic shape interposed between pinch seal portions 13*a* and 13*b* each having a rectangular cross sectional shape. In the glass bulb 12, starting rare gas, mercury and a metal halide, for example a sodium-scandium type light emitting substance, are enclosed. In the pinch seal portions 13*a* and 13*b*, rectangular molybdenum foil members 16*a* and 16*b* are bonded. Tungsten electrodes 15*a* and 15*b* disposed opposite to each other in the enclosed glass bulb 12 are connected to either of the molybdenum foil members 16*a* and 16*b*, while lead wires 18*a* and 18*b* extending to the outside of the arc tube body 11 are connected to the other one of the tungsten electrodes 15*a* and 15*b*. A cylindrical ultraviolet-ray shielding globe 20 having an inner diameter larger than the diameter of the enclosed glass bulb 12 is integrally welded to the arc tube body 11. Thus, regions of the arc tube body 11 from the pinch seal portions 13*a* and 13*b* to the enclosed glass bulb 12 are enclosed and hermetically sealed by the ultraviolet-ray shielding globe 20. Moreover, a rearwardly-extending portion 14*b* (see FIG. 5) which is a non pinch seal portion of the arc tube body 11 and which is formed into a cylindrical pipe projects over the rear end of the globe 20.

The globe 20 is made of quartz glass into which TiO2 and CeO2 have been doped and which has an ultraviolet ray shielding action so as to reliably cut ultraviolet rays of light in a predetermined wavelength region harmful to the human body, light being light emitted by the enclosed glass bulb 12 serving as an electric discharge portion. The inside portion of the globe 20 is made to be a vacuum state or a state in which inactive gas has been enclosed. Thus, the globe 20 has a heat insulating action for insulating heat radiated from the enclosed glass bulb 12 which is the electric discharge portion. As a result, the design is prepared in such a manner that the characteristics of the lamp are not affected by dint of change in the external environment.

Therefore, the metal members, such as the lead support 36 and the slide plate 61, are irradiated with light from which the ultraviolet rays in a predetermined wavelength region have been cut. Thus, the quantity of free electrons which are excited and thus discharged to the outside of the metal members can be reduced. As a result, the problem in that the steam pressure of the light emitting substance in the enclosed glass bulb 12 is reduced can be prevented.

A cylindrical inner tube portion 31 having an opening 32 through which the rearwardly-extending portion 14*b* of the arc tube 10 can be inserted so as to be accommodated is formed in front of the insulating plug 30. A cylindrical outer tube portion 33 having the focusing ring 34 formed at the periphery thereof is formed around the inner tube portion 31 except for a bridge portion 35 (see FIGS. 3 and 6) having a lead-support insertion hole 35*a* formed therein.

A metal base plate 51 for forming a reference plane is hermetically secured to the front end of the cylindrical tube portion 31. As shown in FIGS. 6 and 8 in the form of enlarged views, the base plate 51 has a shape that a cylindrical portion 54 is formed at the inner end of an annular substrate 52. By performing insertion molding which is injection molding which is carried out such that the base plate 51 is inserted into a mold, the base plate 51 is integrated with the insulating plug 30 in a state in which the annular substrate 52 is exposed. Four folded portions 56 folded outwards are formed at the same intervals in the circumferential direction of the leading end of the cylindrical portion 54. The folded portions 56 are embedded in the cylindrical tube portion 31 of the insulating plug 30 to serve as separation stoppers. Thus, the base plate 51 is firmly secured and integrated with the cylindrical tube portion 31. Therefore, there is no risk of the separation, for example, exfoliation, of the base plate 51 from the insulating plug 30.

The front surface of the annular substrate 52 of the base plate 51 integrated with the insulating plug 30 is formed into a reference plane f2 (see FIGS. 5 and 8) running parallel to a reference plane f1 (see FIGS. 2 and 5) of the focusing ring 34 which is a positioning reference member with respect to the reflector 100. A metal vertically-holding member 60 is joined and secured to the upper surface of a base portion 52 of the base plate 51, the vertically-holding member 60 including a metal slide plate 61 and an arc-tube holding band 71 made of a metal material. The vertically-holding member 60 arranged to vertically hold the globe 20 of the arc tube 10 is welded and secured. Thus, an electrically-discharge axis L of the arc tube 10 is brought to a predetermined position on the central axis L2 (refer to FIGS. 2 and 13) of the focusing ring 34.

That is, as shown in FIG. 6, the arc-tube holding band 71 of the vertically-holding member 60 has rectangular tag shape members 74 each of which is folded to have an L-shape cross sectional shape and formed at each of the two butting portions of an elongated band body 72. When the tag shape members 74 of the band body 72 wound around the globe 20 of the arc tube 10 are caused to abut against each other so as to be spot-welded at a spot welding portion 75, the arc-tube holding band 71 can be wound around the globe 20 so as to be secured to the globe 20. Each of two folded portions 73 is formed in the lengthwise direction of the band body 72. When the folded portions 73 are elastically deformed, the band body 72 is contracted in the lengthwise direction. Thus, the band body 72 can be wound around the globe 20 so as to be secured to the globe 20.

As shown in FIGS. 6 and 7, the metal slide plate 61 of the vertically-holding member 60 is formed into an annular shape having a base portion 62 which matches the base 52 of the base plate 51. Four tag shape holding members 64 in the form of leaf springs arranged to be stood erect by cutting are formed at the same intervals in the circumferential direction of the inner end of the base portion 62. The outer surface of the arc-tube holding band 71 wound around the globe 20 of the arc tube 10 and thus secured to the globe 20 is held between the tag shape holding members 64. Moreover, the tag shape holding members 64 are laser-welded to the arc-tube holding band 71 at laser-welded portions 65. Thus, the arc tube 10 is integrated with the slide plate 61 in such a manner that the electrically-discharge axis L of the arc tube 10 is perpendicular to a joining surface f3, which is a bottom surface of the base portion 62 of the slide plate 61 (see FIG. 7), of the slide plate 61 with the base plate 51 and apart from the bottom surface f3 of the base portion 62 for a predetermined distance H1.

The slide plate, namely, the vertically-holding member 61 to which the arc tube 10 has been integrated is slid along the base plate 51. When the electrically-discharging axis L has coincided with the central axis L2, which is the central axis of the electric discharge lamp apparatus, of the focusing ring 34, the arc tube 10 is integrated with the insulating plug through the vertically-holding member 60. Thus, the electrically-discharging axis L of the arc tube 10 is brought to a required position with respect to the focusing ring 34.

An insulating sleeve 38, into which the lead support 36 is inserted, which is formed into a cylindrical pipe shape and which is made of ceramic, is inserted into the sleeve insertion hole 35*a* opened in the front surface of the insulating plug 30. An insertion end of the lead support 36 projects rearwards over a lead-support insertion hole 35*b* (see FIGS. 5 and 10) formed in the bottom portion of the sleeve insertion hole 35*a* and arranged to penetrate the rear side of the insulating plug 30. Then, the insertion end is inserted into an engaging hole 45*a* of a belt-type terminal 44 and welded to the engaging hole 45*a*.

The insulating sleeve 38 is disposed to cover the substantially overall region of a straight portion of the lead support 36 which serves as the positive passage for electric power. Thus, insulation from the lead wire 18*b* at the rear end of the arc tube 10 which serves as a positive-side passage for electric power can be maintained.

As shown in FIG. 10 in an enlarged manner, a tapered hole 35*c* extending to the lead-support insertion hole 35*b* is formed in the bottom portion of the sleeve insertion hole 35*a*. The insertion end of the lead support which has penetrated the insulating sleeve 38 is guided by the tapered hole 35*c* so as to be introduced into the lead-support insertion hole 35*b*. Therefore, the operation for inserting the lead support 36 into the lead-support insertion hole 35*b* can easily be performed.

The diameter of the sleeve insertion hole 35*a* is 25 mm, the outer diameter of the insulating sleeve 38 is 2.1 mm, the inner diameter of the insulating sleeve 38 is 1.0 mm and the outer diameter of the lead support 36 is 0.6 mm. As shown in FIG. 12, design is prepared in such a manner that gaps S1 and S2 each having a size of 0.4 mm are provided between the inner surface of the sleeve insertion hole 35*a* and the outer surface of the insulating sleeve 38 and between the inner surface of the insulating sleeve 38 and the outer surface of the lead support 36. Therefore, even if the outer diameter and inner diameter of the insulating sleeve 38 have a dimension error of about ±0.2 mm or a warp having a size of about 0.3 mm, the apparatus can satisfactorily be operated.

That is, since the insulating plug 30 is a product manufactured from synthetic resin and the lead support 36 is made of a metal material, the diameter of the sleeve insertion hole 35*a* and the outer diameter of the lead support 36 can accurately be realized. However, a dimension error easily be introduced into the outer diameter and inner diameter of the insulating sleeve 38 made of ceramic, usually made of alumina. Moreover, the insulating sleeve 38 is easily warped. Therefore, the diameter of the sleeve insertion hole 35*a* and the outer diameter of the lead support 36 are previously determined in consideration of the dimension error of the insulating sleeve 38 which is molded by sintering. Thus, even if a somewhat error is introduced into the outer diameter, the inner diameter and the straightness of the insulating sleeve 38, insertion and accommodation of the insulating sleeve 38 in the sleeve insertion hole 35*a* and insertion of the lead support 36 into the insulating sleeve 38 are permitted.

The lead support 36 is bent at a substantially right angle toward the central axis of the insulating plug 30 at a position which the lead support 36 is exposed over the front end of the insulating sleeve 38. The front end portion of the arc tube 10 is supported by the folded portion 37. As shown in FIG. 11, two adjacent bent portions 36*a* formed into opposite waveforms each having a curvature radius of 35.9 mm and inflection points P1 and P2 which are apart from each other for h (1.3 mm) are provided for portions of the lead support adjacent to the front end of the same in the lengthwise direction. A pinch portion 37*a* is formed in a folded portion 37 at the leading end of the lead support 36 and arranged to spot-weld the lead wire.

In a state in which the lead support 36 has been inserted into the insulating sleeve 38, the wave-shape bent portions 36*a* are pressed against the inner surface of the insulating sleeve 38, as shown in FIG. 5. Thus, the portion of the insulating sleeve 38 adjacent to the front end of the same is elastically supported by the wave-shape bent portions 36*a* of the lead support 36. As a result, looseness of the insulating sleeve 38 with respect to the lead support 36 can be prevented.

When the lead support 36 is inserted into the insulating sleeve 38, the bent portions 36*a* are elastically deformed into a straight shape as the lead support 36 is inserted into the insulating sleeve 38. Therefore, the lead support 36 can smoothly be inserted into the insulating sleeve 38. In particular, the bent portions 36*a* formed adjacent to the front end of the lead support 36 does not cause great slide and frictional resistance when the lead support 36 is inserted into the insulating sleeve 38.

The bent portions 36*a* are formed in the same plane as that of the lead support folded portion 37 which supports the front end portion of the arc tube 10. Therefore, also a load which acts from the front end portion of the arc tube 10 on the lead support 36 can be borne.

As described above, the size (the curvature radius of 35.9 mm and the vertical distance between the inflection points P1 and P2 of the bent portions of 1.3 mm) of the bent portions 36*a* of the lead support and the gap S2 (0.4 mm) between the inner surface of the insulating sleeve 38 and the outer surface of the lead support 36 are determined. That is, the determined dimensions enable the bent portions 36*a* of the lead support 36 inserted into the insulating sleeve 38 to be pressed against the inner surface of the insulating sleeve 38. Thus, the insulating sleeve 38 can be integrated with the lead support 36. Moreover, (the bent portions 36*a* of) the lead support 36 can smoothly be inserted into the insulating sleeve 38.

The lead-support insertion hole 35*b* and the lead-support engaging hole 45*a* are made to be, by δ (0.4 mm or greater), eccentric toward the outside of the central axis of the focusing ring 34 from the sleeve insertion hole 35*a*. In a state in which the insertion end of the lead support 36 has been inserted, welded and secured to the holes 35*b* and 45*a*, the lead support 36 which is eccentric with respect to the sleeve insertion hole 35*a* and which extends straight presses a side portion of the inner surface of the insulating sleeve 38 against the inner surface of the sleeve insertion hole 35*a*, as shown in FIG. 12. As a result, a state is realized in which the overall body of the insulating sleeve 38 is held between the lead support 36 and the inner surface of the sleeve insertion hole 35*a*.

Therefore, the insulating sleeve 38 inserted into the sleeve insertion hole 35*a* does not rattle with respect to the sleeve insertion hole 35*a* in spite of the provided gap S1 from the sleeve insertion hole 35*a* and the gap S2 from the lead support 36.

Since forward movement of the insulating sleeve 38 is inhibited by the folded portion 37 at the leading end of the lead support 36, fore-and-aft directional rattle of the insulating sleeve 38 can be prevented.

Since the lead-support insertion hole 35*b* is eccentric from the sleeve insertion hole 35*a*, the insertion end of the lead support 36 cannot easily be inserted into the lead-support insertion hole 35*b*. However, the insertion end of the lead support 36 forcibly inserted to the bottom of the sleeve insertion hole 35*a* is guided into the lead-support insertion hole 35*b* along the tapered hole 35*c*. Therefore, insertion can easily and reliably be performed.

A cylindrical outer tube portion 42 extending rearwards and a cylindrical boss 43 extending rearwards in the outer tube portion 42 are formed at the rear end of the insulating plug 30. The cylindrical belt-type terminal 44 constituting the negative terminal of the lamp-side connector C2 is integrally secured to the outer surface of the base portion of the outer tube portion 42. Moreover, a cap-type terminal 47 serving as a positive-side terminal of the lamp-side connector is integrally fit to the boss 43.

As shown in FIGS. 13 and 14, the belt-type terminal 44 has a cylindrical shape provided with an outward flange 45.

The belt-type terminal 44 is integrated with the insulating plug 30 by insertion molding which is performed such that injection molding is carried out in a state in which the belt-type terminal 44 has been inserted into a mold. The outward flange 45 has an engaging hole 45*a* to which the rear end of the lead support 36, which has penetrated the insulating plug 30, is secured by laser welding. Moreover, three cut portions 45*b* for positioning the belt-type terminal 44 to the circumferential direction with respect to the insulating plug 30 are, at the same intervals, provided for the outward flange 45 in the circumferential direction.

Four vertical ribs 43*a* extending in the axial direction are, at the same intervals, provided for the outer surface of the boss 43 in the circumferential direction. Therefore, the adhesive force of the cap-type terminal 47 fitted to the boss 43 can be enlarged. As a result, separation of the cap-type terminal 47 can be prevented. A lead-wire engaging hole 48 is formed at the top end of the cap-type terminal 47. Thus, the lead wire 18*b* extending from the rear end of the arc tube 10 and allowed to pass through the opening 32 of the insulating plug 30 and the lead-wire insertion hole 43*b* is engaged and laser-welded to the engaging hole 48.

Figure 16:
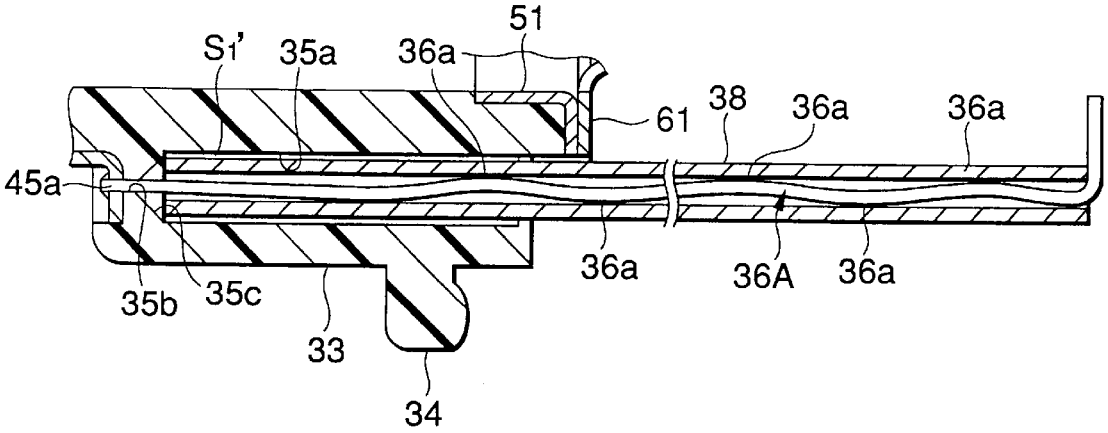
FIG. 16 is an enlarged cross sectional view showing a second embodiment of the present invention.
Figure 17:
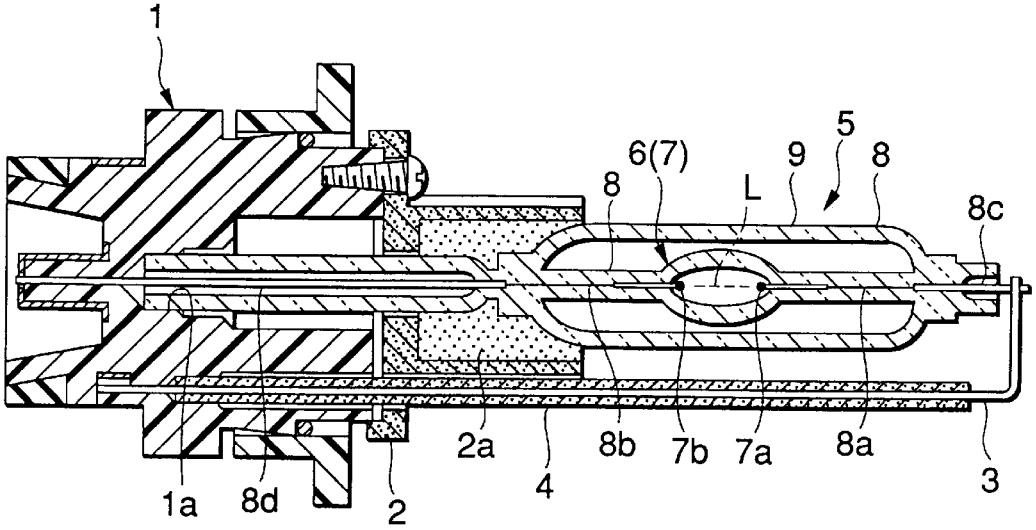
FIG.17 PRIOR ART
FIG. 17 is a vertical cross sectional view showing another conventional electric discharge lamp apparatus.

FIG. 16 is an enlarged cross sectional view showing a second embodiment of the present invention.

The first embodiment has the structure that the lead-support insertion hole 35*b* into which the rear end of the lead support 36 is inserted is eccentric from the sleeve insertion hole 35*a*. In this embodiment, the lead-support insertion hole 35*b* into which the rear end of the lead support 36A is inserted and the engaging hole 45*a* of the belt-type terminal 44 to which the rear end of the lead support 36A is welded and secured coincide with the central axis of the sleeve insertion hole 35*a*. As a result, gap S1' is provided between the inner surface of the sleeve insertion hole 35*a* and the outer surface of the insulating sleeve 38.

The waveform bent portions 36*a* are, at the same intervals, provided for the overall length of the straight portion of the lead support 36A. Thus, the insulating sleeve 38 is hermetically integrated with the lead support 36A. Therefore, rattle of the insulating sleeve 38 with respect to the lead support 36A and that with respect to the sleeve insertion hole 35*a* can be prevented.

The other structures are the same as those of the first embodiment. The same elements are given the same reference numeral and the same elements are omitted from description.

The above-mentioned embodiments have the structure that the ultraviolet-ray insulating globe 20 is integrally welded to the arc tube body 11. The present invention may be applied to an electric discharge lamp apparatus having a structure that the ultraviolet-ray insulating globe 20 is not welded to the arc tube body 11; the leading end portion of the arc tube body 11 is supported by the lead support 36; the rear end of the arc tube body 11 is supported by another metal support member secured to the front surface of the insulating plug 30; and the arc tube body 11, the lead support 36 and the overall body of the other metal support member are surrounded by a cup-shape ultraviolet-ray insulating globe having the base portion which is secured to the front surface of the insulating plug 30.

The first and second embodiments have the structure that the insulating sleeve 38 is disposed to cover the substantially overall straight portion of the lead support 36 (36A). The present invention may be applied to an electric discharge lamp apparatus having a structure that a lead support is allowed to project over the front surface of the insulating plug 30 by integral molding or the like; and the insulating sleeve 38 is disposed to cover only the portion of the lead support forwards projecting over the insulating plug.

In the above-described embodiemts, the bent portions 36*a* are provided separately from the folded portion 37. Instead, a part of the folded portion 37 may press against the insulating sleeve 38, namely may serves as a bent portion 36*a* to contact with the insulating sleeve 38 without any separate bent portions.

As can be understood from the description, the electric discharge lamp apparatus according to the embodimets of the invention have the structure that the diameter of the insulating sleeve is sufficiently larger than the outer diameter of the lead support. Therefore, insertion of the lead support into the insulating sleeve can smoothly be performed. As a result, assembly of the electric discharge lamp apparatus can be facilitated.

Since the lead support and the insulating sleeve are hermetically integrated with each other through the bent portion, the two elements are moved and swung together with each other even with transmitted vibrations. Therefore, the problems experienced with the conventional structure, for example, rattle between the two elements, collision noise and breakage of the insulating sleeve can be prevented.

Even an insulating sleeve which has been determined as a defective product because of, for example, a considerably great difference in the inner diameter can be employed as an adequate product. Therefore, the manufacturing yield of the molded insulating sleeve can be improved. As a result, the cost of the electric discharge lamp apparatus can be reduced.

Futhermore, the insulating sleeve is disposed to cover the substantially overall region of the straight portion of the lead support. Therefore, insulation can be maintained between the lead support, which is the passage for electric power, and the corresponding passage for electric power.

Since the diameter of the sleeve insertion hole is sufficiently larger than the outer diameter of the insulating sleeve, insertion of the insulating sleeve into the sleeve insertion hole can smoothly be performed. As a result, assembly of the electric discharge lamp apparatus can furthermore easily be performed. Although the gap is formed between the insulating sleeve and the sleeve insertion hole, the structure that the insulating sleeve and the lead support are hermetically integrated with each other prevents rattle of the insulating sleeve with respect to the sleeve insertion hole.

Still further, the rear end of the lead support can smoothly be inserted into the lead-support insertion hole which penetrates the rear side of the insulating plug. Therefore, the operation for joining the lead support to the insulating plug can easily be performed. As a result, the assembly of the electric discharge lamp apparatus can furthermore easily be performed.

Yet futher, the insulating sleeve is hermetically held in the sleeve insertion hole by the lead support which is eccentric from the sleeve insertion hole. Therefore, the insulating sleeve is not rattled with respect to the sleeve insertion hole. Thus, the problem of noise furthermore satisfactorily be prevented.

Since an insulating sleeve having a somewhat error in the outer diameter can be employed as an adequate product, the manufacturing yield of the molded insulating sleeves can significantly be improved.

What is claimed is:

1. An electric discharge lamp apparatus comprising:

an arc tube;

an insulating plug made of synthetic resin, the insulating plug supporting the arc tube;

a metal lead support serving as a passage for electric power to be supplied to the arc tube, wherein the metal lead support has a bent portion;

an insulating sleeve made of a ceramic wherein the insulating sleeve has a hollow pipe shape and an inner surface into which the lead support is inserted, wherein a predetermined gap is provided between the inner surface of the insulating sleeve and an outer surface of the lead support, and the bent portion of the metal lead support comes into contact with the inner surface of the insulating sleeve, wherein the insulating plug has a sleeve insertion hole which is opened in the front surface of the insulating plug and through which the rear end of the insulating sleeve is inserted so as to be accommodated, and a predetermined gap is provided between the inner surface of the sleeve insertion hole and the outer surface of the insulating sleeve, and wherein the insulating plug has a lead-support insertion hole, and a tapered hole communicating between the sleeve insertion hole and the lead-support insertion hole.

2. The electric discharge lamp apparatus according to claim 1, wherein the lead-support insertion hole is eccentric with respect to the sleeve insertion hole, and the lead support which is inserted through the lead-support insertion hole and which is eccentric with respect to the sleeve insertion hole presses a side surface of the insulating sleeve against the inner surface of the sleeve insertion hole.

3. The electric discharge lamp apparatus according to claim 1, wherein the metal lead support further comprises a support body and a folded leading end folded from the support body, and the bent portion is formed at the support body near the folded leading end to press against an inner surface of the insulating sleeve at plural points.

4. The electric discharge lamp apparatus according to claim 3, wherein the bent portion of the metal lead support includes plural waveform bent portions which are provided substantially over the length of the support body.

5. The electric discharge lamp apparatus according to claim 1, wherein the metal lead support and the insulating sleeve into which the metal lead support is inserted are positioned outside the arc tube.

6. The electric discharge lamp apparatus according to claim 1, wherein the metal lead support further comprises a support body, a first folded leading end folded from the support body and a pinch portion folded from the first folded leading end so that a lead wire of the discharge lamp can be held by the first folded leading end and the pinch portion.

* * * * *